United States Patent [19]

Kato

[11] Patent Number: 4,553,290

[45] Date of Patent: Nov. 19, 1985

[54] APRON FOR A DRAFT APPARATUS

[75] Inventor: Hisaaki Kato, Shiga, Japan

[73] Assignee: Murata Kikai Kabushiki Kaisha, Japan

[21] Appl. No.: 577,966

[22] Filed: Feb. 8, 1984

[30] Foreign Application Priority Data

Feb. 14, 1983 [JP] Japan ..... 58-22531

[51] Int. Cl.[4] ..... D01H 5/86

[52] U.S. Cl. ..... 19/244; 19/236; 474/263

[58] Field of Search ..... 19/244, 153, 248, 249, 19/250; 474/262, 263, 264; 428/114, 295

[56] References Cited

U.S. PATENT DOCUMENTS

| | | | |
|---|---|---|---|
| 2,402,356 | 6/1946 | Bacon et al. | 19/244 |
| 3,011,221 | 12/1961 | Howell | 19/244 |
| 4,083,260 | 4/1978 | Carlson et al. | 474/263 X |
| 4,127,039 | 11/1978 | Hollaway | 474/263 |

*Primary Examiner*—Louis K. Rimrodt
*Assistant Examiner*—J. L. K. Olds
*Attorney, Agent, or Firm*—Spensley Horn Jubas & Lubitz

[57] ABSTRACT

An apron for a draft apparatus being suitable for use with a pneumatic high speed spinning frame. The apron includes a front side rubber layer, a reverse side rubber layer adhered to the front side rubber layer and core cords interposed between the two rubber layers. A ratio of thickness between the front side rubber layer and the reverse side rubber layer is set to a value within a range from 3:7 to 1:9.

6 Claims, 12 Drawing Figures

FIG. 2
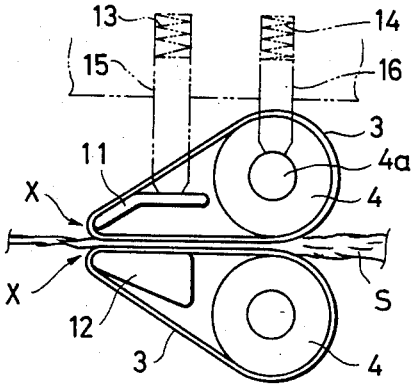
FIG. 3-a
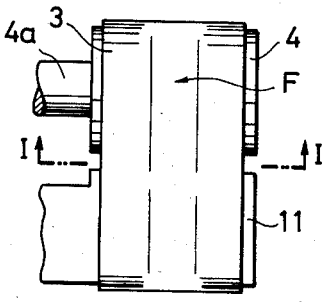
FIG. 3-b
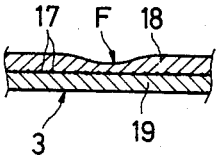
FIG. 4-a
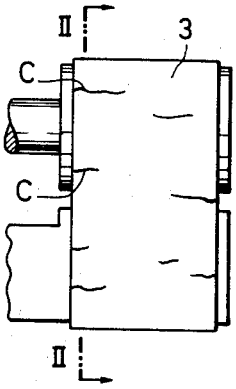
FIG. 4-b
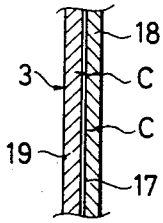

FIG. 5-a
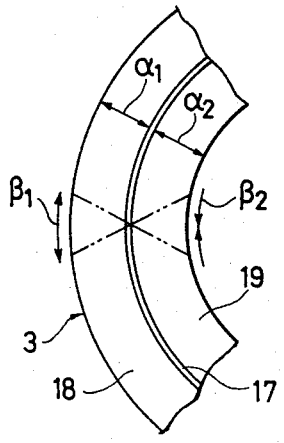
PRIOR ART
FIG. 5-b
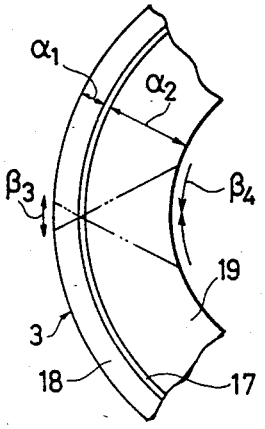
FIG. 6
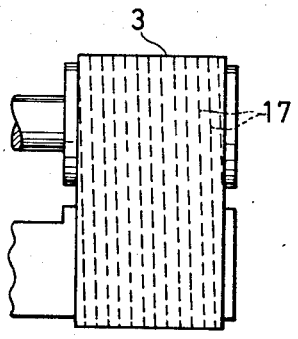
FIG. 7
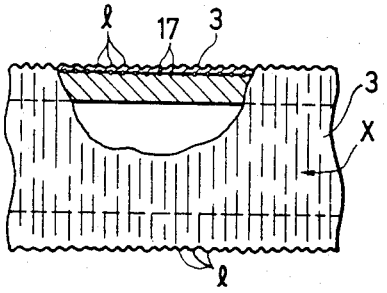

APRON FOR A DRAFT APPARATUS

BACKGROUND OF THE INVENTION

1. Field of the Invention:

This invention relates to an apron for a draft apparatus which is suitable for use with a spinning machine, especially with a pneumatic high speed spinning frame and further to a method of producing the same.

2. Prior Art:

A draft apparatus is already known in the art in which, in order to draft slivers, such slivers are passed sequentially between a plurality of pairs of pressure contacted rollers, which are arranged such that they have gradually increasing circumferential speeds arranged in the order of the slivers advance. In such known draft apparatuses, one particularly serious problem is how to reduce draft irregularities which have a worsening effect on the qualities of the yarns, such as uniformity, strength, and so on.

In a draft apparatus of a three line type, such rollers as described above include back, middle and front roller pairs, and a belt commonly called an apron is mounted on each of the rollers of the middle roller pair. One of causes of such irregularities as mentioned above is deformation of an apron due to wear. Particularly when compared with a spinning frame such as one of the ring type in which a draft rate is low, a pneumatic spinning frame operates at a high speed and directly drafts slivers. Consequently, in a pneumatic spinning frame, the draft rate is very high and the middle rollers are rotated also at a high speed, resulting in rapid progress of deformation of the middle rollers by wear.

SUMMARY OF THE INVENTION

An object of the present invention is to provide an apron which can eliminate deformation by wear and cracks.

According to the present invention, the apron includes a front side rubber layer, a reverse side rubber layer adhered to the front side rubber layer, and core cords interposed between the two rubber layers, and a ratio of thickness between the front side rubber layer and the reverse side rubber layer of a value within a range from 3:7 to 1:9.

BRIEF DESCRIPTION OF THE DRAWINGS

FIG. 2 is a side elevational view showing middle rollers of the pneumatic spinning frame;

FIG. 3*a* is a plan view of an apron which has a low wear resistance, illustrating deformation of the apron due to wear and FIG. 3*b* is a sectional view taken along line I—I of FIG. 3*a;*

FIG. 4*a* is a plan view of an apron which has a high wear resistance, illustrating cracks appearing on the apron and FIG. 4*b* is a sectional view taken along line II—II of FIG. 4*a;*

FIG. 5*a* is a side elevational sectional view showing a bent portion of a conventional apron and FIG. 5*b* is a similar view showing a bent portion of an apron according to the present invention;

FIG. 6 is a plan view of a apron illustrating core cords thereof;

FIG. 7 is a front elevational view of a bent portion of an apron in which a front side rubber layer is relatively thin;

DETAILED DESCRIPTION OF THE INVENTION

Figure 1:
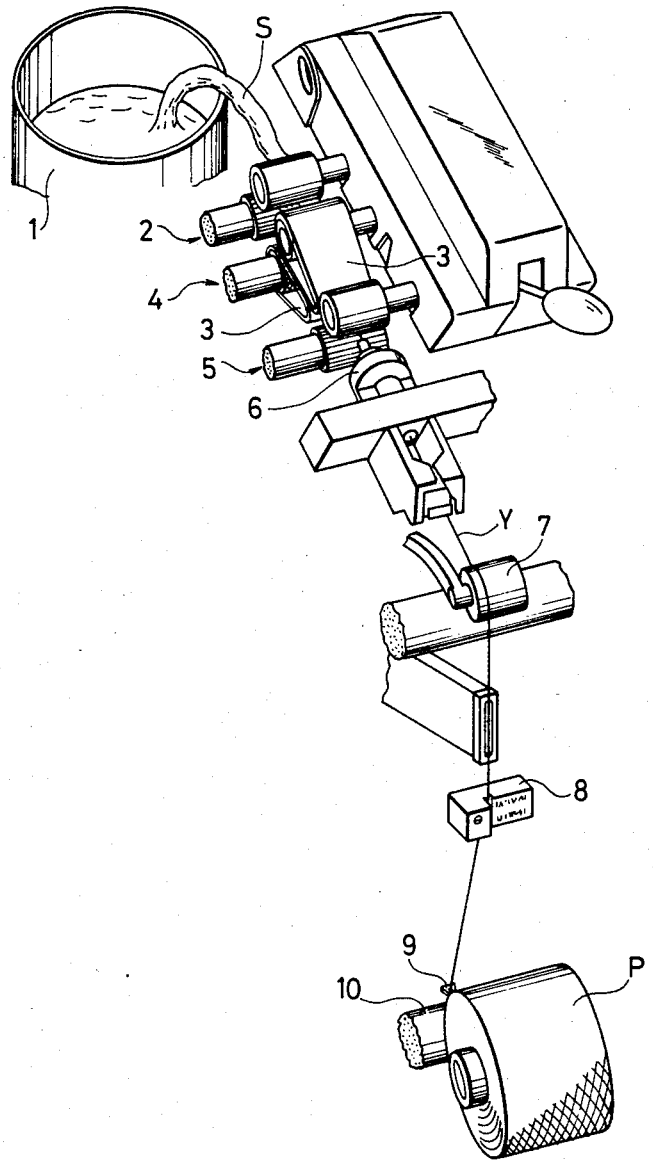
FIG. 1 is a perspective view showing a general construction of a pneumatic spinning frame.

The deformation of an apron due to wear will be described more particularly with reference to FIGS. 1 to 3: FIG. 1 illustrates details of a construction of a pneumatic spinning frame; FIG. 2 illustrates middle rollers of the pneumatic spinning frame of FIG. 1; and FIG. 3 shows an apron which has been deformed by wear. Referring to FIG. 1, slivers S drawn out from a sliver can 1 are passed in order between and drafted by a pair of back rollers 2, a pair of middle rollers 4 each having an apron 3, and front rollers 5. The rollers 2, 4 and 5 in each pair are rotated in mutually contacted conditions under pressure. The slivers S are then twisted into a spinning yarn Y be means of an air jet nozzle 6. The spinning yarn Y is thereafter drawn out by a delivery roller 7, passes a yarn clearer 8, a traverse guide 9 and a friction roller 10, and is wound onto a package P. Referring now to FIG. 2, a tensile force is applied to each of the aprons 3 by means of a cradle 11 or a tenser bar 12. Pins 15 and 16 are urged into engagement with the cradle 11 and a shaft 4*a* for the upper one of the middle rollers 4 by means of springs 13 and 14, respectively, thereby to furnish the aprons 3 with a force to press slivers S therebetween.

In each of the aprons 3 as described just above, deformation F due to wear will appear on a portion thereof along a path of slivers S as seen in FIG. 3. Since such an apron 3 normally includes two rubber layers 18 and 19 adhered to each other and core cords 17 interposed between the rubber layers 18 and 19, such deformation appears on a front side of the front side rubber layer 18. Due to such deformation, a desired pressure cannot be maintained between both aprons 3.

It has been a common practice to improve the wear resistance of the front side rubber layer 18 in order to prevent deformation thereof due to wear. But this is naturally followed by an increase of hardness of the rubber layer 18, and cracks C might appear to the rubber layer 18 as shown in FIG. 4*a*. Such cracks C would be caused due to the fact that the apron 3 is bent in some acute angle as at a location X of FIG. 2, and most of such cracks C appear at end portions of the apron 3 and remain in the front rubber layer 18, also constituting one of causes of draft irregularities. Further, trouble can also be caused frequently in that fibers are caught by such cracks C and thus become entwined with the apron 3.

Thus, with such circumstances taken into consideration, the present invention has been made successfully after considerable efforts, and according to the present invention, a structure of an apron which can eliminate deformation by wear and cracks is provided. Such an apron can be realized by setting a ratio of thickness between a front side rubber layer and a reverse side rubber layer to a value within a range from 3:7 to 1:9.

The present invention will now be described in comparison with an example of a conventional apron. In the conventional apron 3, a ratio $\alpha 1:\alpha 2$ of thickness between the front side rubber layer 18 and the reverse side rubber layer 19 is designed to be almost 5:5 as seen in FIG. 5*a*, and accordingly, the bending stress $\beta 1$ acting in the direction to extend the surface of the front side rubber layer 18 around the bending location X is substantially equal in value to another bending stress $\beta 2$ acting in the direction to compress the surface of the reverse side rubber layer 19. Thus, where the front side rubber layer 18 is made of a material which has a high wear resistance, it will be damaged by such a great bending stress $\beta 1$ in the extending direction and will have cracks C caused thereby. Here, most of the core cords 17 are actually made of cotton yarns, and the core cords 17 are spirally wound around a periphery of the apron 3 as shown in FIG. 6 and thus have a low percentage of elongation yield against a tensile force so that, in the example as shown in FIG. 5*a*, they act as a neutral plane relative to the two stresses $\beta 1$ and $\beta 2$. FIG. 5*b* shows an apron according to the present invention in which the ratio $\alpha 1:\alpha 2$ of thickness between the front and reverse side rubber layers 18 and 19 is set between 3:7 to 1:9. In this case, the core cords 17 acting as a neutral plane are displaced towards the front side of the apron 3 when compared with the case of FIG. 5*a*. As a result, bending stresses $\beta 3$ and $\beta 4$ acting opposite surfaces of both rubber layers 18 and 19 change as shown in FIG. 5*b*, and thus the bending stress $\beta 3$ on the surface of the front side rubber layer 18 is considerably small when compared with the case of FIG. 5*a*. Accordingly, the front side rubber layer 18 is prevented from suffering from occurrence of cracks C irrespective of the material thereof, thereby allowing stabilized drafting without draft irregularities. Normally, a material containing NBR as a main component therein is employed for each of the rubber layers 18 and 19, and particularly a material containing a high percentage of nitrile therein is employed for the front side rubber layer 18 in order to improve the wear resistance of the same. Thus, after various experiments with an apron 3 in which such common materials are used, it has been found that the frequency of occurrence of cracks C decreases as a ratio $\alpha 1$ of thickness of the front side rubber layer 18 in the thickness ratio $\alpha 1:\alpha 2$ decreases, and particularly below a border of the ratio when thickness $\alpha 1:\alpha 2$ is 3:7, results which allow actual use can be obtained. In particular, though depending upon a material of rubber, when draft running was performed with the ratio of thickness set to 5:5, cracks C appeared, in some extreme cases, in several hours after use of the apron and hence it was necessary to replace apron 3 by another. However, it was confirmed that, where the ratio $\alpha 1$ of thickness of the front side rubber layer 18 is set below 3, the apron can stand continuous draft running for a period of a least 90 days, and thus, it was made clear that such an apron can be used in sufficiently stablized conditions by such normal maintenance as is performed once during a period of three months. At the same time, it was also acknowledged that the $\alpha 1$ thickness of the front side rubber layer 18 below 1 would cause another problem as will be described below. In particular, where the $\alpha 1$ thickness is too low, the core cords 17 are located adjacent the surface of the apron 3 and hence the strength of the front side rubber layer 18 is reduced, making the rubber layer 18 readily breakable and making production of the rubber layer 18 difficult. And further, as shown in FIG. 7, only portions of the surface of the front side rubber layer 18 in which core cords 17 exist project like stripes therefrom so that the front side rubber layer 18 is curved in the form of fine corrugations. As a result, a bending stress in the extending direction due to such fine corrugations is caused concentrated in the stripe-like portions l and cooperates with the bending stress $\beta 1$ and $\beta 3$ in the extending direction as described above with reference to FIG. 5 to destroy the front side rubber layer 18 by causing cracks C. Such cracks C by this cause are almost elminated by increasing the $\alpha 1$ thickness of the front side rubber layer 18 higher than 1.

Figure 8:
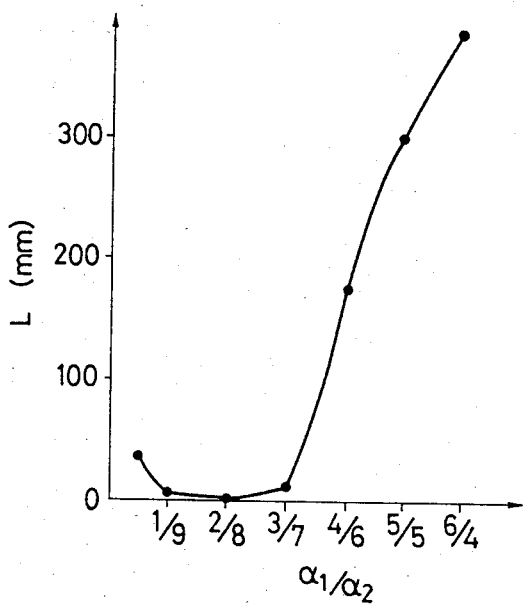
FIG. 8 is a diagram illustrating a relationship between a ratio of thickness between rubber layers and conditions of occurrence of cracks.

Although it is difficult to quantitatively show conditions of occurrence of cracks C, they are quantified by a following method, and an example of an experiment regarding a relationship thereof to the ratio of thickness is illustrated in the diagram of FIG. 8. The results were obtained with a sample apron 3 which is a quite conventional one including a front side rubber layer 18 having Shore hardness of 78.0 which is an inner diameter of 37 mm and a width of 32 mm, and which is continuously run at a surface speed of 6 m/min for a period of 500 hours. In FIG. 8, the total crack length is designated by L and is a sum total of measurements of length of all of the individual cracks C and notably indicates that it assumes the lowest value within a range of the ratio of thickness $\alpha 1/\alpha 2$ between 1/9 and 3/7. In this experiment, when the ratio of thickness $\alpha 1/\alpha 2$ was higher than 4/6, large cracks C appeared at end and central portions of the apron 3, but when the ratio was between 3/7 and 1/9, a minimum number of cracks C of minimum length appeared at end portions of the apron, and when the ratio was below 1/9, a relatively large number of cracks C of minimum length appeared over the entire apron.

It is to be noted that in order to reduce the stripe-like portions l to smooth the surface of the front side rubber layer 18 and in order to strengthen the action of the core cords 17 as a neutral plane, it is desirable that a yarn used for the core cords 17 is fine and strong and is wound closely. Cloth and leather can also be used as a material of the core cords 17, and naturally it is also effective to make the thickness of the apron 3 itself thinner independently of the ratio of thickness. But there also is a limit in such methods, and they cannot vary the effects attained by the setting of the ratio of thickness between the rubber layers 18 and 19 as described above.

Figure 9:
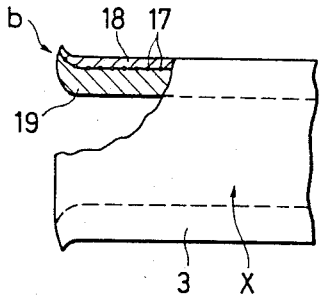
FIG. 9 is a front elevational view showing a bent portion of an apron.

Further, in order to further control occurrence of cracks C at end portions of the apron 3, it is preferable to employ for the reverse side rubber layer 19 a material having a low Poisson's ratio when compressed. In particular, if the ratio $\alpha 1$ of thickness of the front side rubber layer 18 is reduced while the ratio $\alpha 2$ of thickness of the reverse side rubber layer 19 is raised, then the bending stress $\beta 3$ of the front side rubber layer 18 becomes low as already described with reference to FIG. 5 so that the rubber layer 18 will hardly suffer as a whole from occurrence of cracks C while on the contrary the bending stress $\beta 4$ of the reverse side rubber layer 19 in the compressing direction becomes relatively high. Since synthetic rubber such as NBR and thermoplastic resins which are used as a material of the rubber layer 18 or 19 are better in compression characteristics than in tension characteristics, no crack C might be caused by compression of the reverse side rubber layer 19 even if the bending stress $\beta 4$ thereof in the compressing direction is rather high. But if the Poisson's ratio of the rubber layer 19 is high, the apron 3 is entirely widened excessively in a widthwise direction, and in addition, a swollen portion b may be formed as an angle at an end portion of the apron 3 in the bending location X as seen in FIG. 9. In particular, where the Poisson's ratio is high, the reverse side rubber layer 19 is easily swollen outwardly in the bending location X to push up an end portion of the front side rubber layer 18, and the portion of the front side rubber layer 18 thus swollen is acted upon by a bending stress in an extending direction thereby to produce conditions which will readily cause cracks therein. In order to reduce the Poisson's ratio, it is effective to dispersedly mix short fibers such as polyester filaments or the like into the reverse side rubber layer 19 to reduce the degree of freedom of the rubber layer 19.

As apparent from the foregoing description, according to the present invention, an apron of a conventional type in which a wear resisting material is employed for a front side rubber layer is constructed such that the ratio of thickness between the front side rubber layer and the reverse side rubber layer is set to be within a range from 3:7 to 1:9. As a result, occurrences of cracks in the front side rubber layer can be reduced considerably, and occurrences of damages to the apron and of draft irregularities can be prevented, thereby assuring stabilized spinning.

What is claimed is:

1. An apron for a draft apparatus comprising a front side rubber layer, a reverse side rubber layer adhered to said front side rubber layer, and core cords interposed between said front and reverse side rubber layers, wherein the ratio of thickness of said front side rubber layer to the thickness of said reverse side rubber layer is within a range from 3:7 to 1:9.

2. An apron as claimed in claim 1, wherein the surface of the front side rubber layer is smooth, and said core cords are made of yarn, cloth, or leather.

3. An apron as claimed in claim 1, wherein said reverse side rubber layer is a material having a Poisson's ratio lower than that of synthetic rubber or thermoplastic resin, when compressed.

4. An apron as claimed in claim 3, wherein short fibers are dispersedly mixed into the reverse side rubber layer to reduce the degree of freedom of the reverse side rubber layer.

5. An apron for a draft apparatus comprising a front side rubber layer and a reverse side rubber layer, wherein the thickness ratio of said front side layer to said reverse side rubber layer ranges from 3:7 to 1:9.

6. The apron of claim 5 further including core cords between said front and reverse side rubber layers.

* * * * *